US007789982B1

(12) United States Patent
Gefken et al.

(10) Patent No.: US 7,789,982 B1
(45) Date of Patent: Sep. 7, 2010

(54) FLEXIBLE DILUTE EXPLOSIVE DEVICE

(75) Inventors: Paul R. Gefken, Mountain View, CA (US); Gary R. Greenfield, San Jose, CA (US); Robert J. Bell, San Jose, CA (US)

(73) Assignee: SRI International, Menlo Park, CA (US)

( * ) Notice: Subject to any disclaimer, the term of this patent is extended or adjusted under 35 U.S.C. 154(b) by 888 days.

(21) Appl. No.: 11/701,966

(22) Filed: Feb. 2, 2007

(51) Int. Cl.

| | |
|---|---|
| ***C06B 45/00*** | (2006.01) |
| ***C06B 45/04*** | (2006.01) |
| ***C06B 45/06*** | (2006.01) |
| ***C06B 25/00*** | (2006.01) |
| ***C06B 25/32*** | (2006.01) |
| ***D03D 23/00*** | (2006.01) |
| ***D03D 43/00*** | (2006.01) |

(52) U.S. Cl. ..... 149/109.4; 149/2; 149/17; 149/18; 149/88; 149/93

(58) Field of Classification Search ..... 149/2, 149/17, 18, 88, 93, 109.4
See application file for complete search history.

(56) References Cited

U.S. PATENT DOCUMENTS

| | | | |
|---|---|---|---|
| 4,722,280 | A | 2/1988 | Sanai |
| 5,417,161 | A | 5/1995 | Sanai et al. |
| 5,507,889 | A | 4/1996 | Mullay et al. |

*Primary Examiner*—Jerry Lorengo
*Assistant Examiner*—James E McDonough
(74) *Attorney, Agent, or Firm*—Lumen Patent Firm

(57) ABSTRACT

A flexible dilute explosive device is provided that includes an explosive material, such as pentaerythritol tetranitrate (PETN), combined with a non-reactive matrix material, such as light-weight polymer beads, and the combination is held in flexible packaging. The flexible packaging includes fabric, antistatic, evacuated and plastic housings. The flexible dilute explosive device can be applied to any contoured shape in the field. It has a total density that is typically between 5 to 10% greater than its explosive density and can be reliably detonated at lower explosive densities. By using different packaging methods, the flexible dilute explosive device can be made to have a fixed explosive density, or a field tailored explosive density using a variable volume housing. It can have a reduced explosive density by adding inert foam blocks to the combination, having an overall volumetric explosive density reduced to 2.5 lb/ft$^3$ (0.04 g/cm$^3$).

19 Claims, 5 Drawing Sheets

(a)

(b)

(a)

(b)

FLEXIBLE DILUTE EXPLOSIVE DEVICE

STATEMENT REGARDING FEDERALLY SPONSORED RESEARCH OR DEVELOPMENT

The present invention was supported by the U.S. Government. The U.S. Government has certain rights in the invention.

FIELD OF THE INVENTION

The invention relates generally to explosive devices. More particularly, the invention relates to an explosive material and non-reactive matrix material combination in a bendable housing with explosive devices having variable detonation pressure.

BACKGROUND

An important need exists for pliant explosive devices with field-selectable detonation pressures for applications such as general demolition of structures and simulation of different explosive loading conditions in controlled tests. The ability to provide explosive devices with detonation pressures adjustable over kilo-bar ranges, while held in flexible packaging, has been an ongoing study, where it is desirable to have an impulse that can be controlled independently by adjusting the explosive concentration, device geometry and configuration. Additionally, it is desirable that such devices are easily fabricated and able to be field-adjusted according to the required detonation pressure and velocity. Previous attempts in providing flexible explosive devices have found limited success that resulted in rigid bodies. These previous devices require complex and elaborate fabrication methods that include heating a mixture in a desiccated mold, cooking the mixture to a foaming state, then recovering an inflexible molded explosive block. To overcome the current shortcomings in the art, what is needed is an explosive device having a flexible packaging system. The system needs to have simplified and reduced fabrication time and costs, lower overall weight, lowered explosive density detonation, and field tailorable explosive density.

SUMMARY OF THE INVENTION

The current invention provides a flexible dilute explosive device. The device uses a first housing for holding a combination of an explosive material and a non-reactive matrix material that is enclosed in an antistatic housing, where in one aspect of the invention, the first housing is a fabric bag or a cotton bag. The antistatic housing is enclosed in an evacuated housing, and a detonator is attached to the evacuated housing, where in one aspect of the invention, the evacuated housing is an evacuated bag.

In one aspect of the invention, hook and pile are attached to the evacuated bag for combining multiple evacuated housings.

In another aspect of the invention, the explosive material is a powder having grain sizes between 5 and 10 microns. In other embodiments, the explosive material may be selected from a group consisting of pentaerythritol tetranitrate (PETN), and cyclotrimethylene trinitramine (RDX) or other powdered explosives that have grain sizes between 5 and 10 microns.

In a further aspect of the invention, the non-reactive matrix material is a light-weight polymer bead selected from a group consisting of pre-puffed polystyrene beads, expanded polypropylene (EPP), porous expanded polypropylene (P-EPP), and expanded polyethylene (EPE).

In another embodiment of the invention, the combination of explosive material and non-reactive material has a weight ratio of about eight, respectively. In a further aspect, the mixture combination has an explosive density between 0.10 and 0.50 grams per cubic centimeter.

In another embodiment of the invention, the non-reactive matrix further comprises non-reactive matrix blocks having at least 0.5 inch spacing there between, where in one aspect of the invention the explosive material and non-reactive matrix combination has an explosive density as low as 0.04 grams per cubic centimeter.

In one embodiment of the invention, the antistatic housing is sealed and has a plurality of openings at an end of the antistatic housing.

In another embodiment of the invention, the detonator has a detonation strength equal to or greater than a Cap 8 detonator. In another aspect of the invention, the detonator is a detonation train. The detonation train can include explosive material positioned along an edge of the first housing, where the explosive material can have a linear density of about 0.5 grams per inch of length of the first housing or can be made up of detonator cord that has a linear density greater than 50 grains per foot. Further, the detonation train includes a detonator cord attached to the evacuated housing and positioned along the first housing edge, where the detonator cord has a linear density greater than 50 grains per foot. Additionally, a detonator may be attached to the detonator cord.

In another embodiment of the invention, the flexible dilute explosive device has an outer plastic coating on the evacuated housing. In one aspect of the invention, hook and pile are attached to the plastic coating for combining multiple evacuated housings.

In another embodiment of the invention, the first housing is an antistatic bag, and the antistatic housing and said evacuated housing are replaced by a compression housing having a variable-volume, where the compression housing enables selective compression of the explosive material and non-reactive matrix combination to a density between 0.10 and 0.50 grams per cubic centimeter. The compression housing may be an antistatic compression housing.

The key advantages of the invention are in providing flexible packaging system, reduced fabrication time and costs, lower overall weight, lower explosive density detonation ability, and field tailorable explosive density.

BRIEF DESCRIPTION OF THE FIGURES

The objectives and advantages of the present invention will be understood by reading the following detailed description in conjunction with the drawing, in which.

DETAILED DESCRIPTION OF THE INVENTION

Although the following detailed description contains many specifics for the purposes of illustration, anyone of ordinary skill in the art will readily appreciate that many variations and alterations to the following exemplary details are within the scope of the invention. Accordingly, the following preferred embodiment of the invention is set forth without any loss of generality to, and without imposing limitations upon, the claimed invention.

Figure 1:
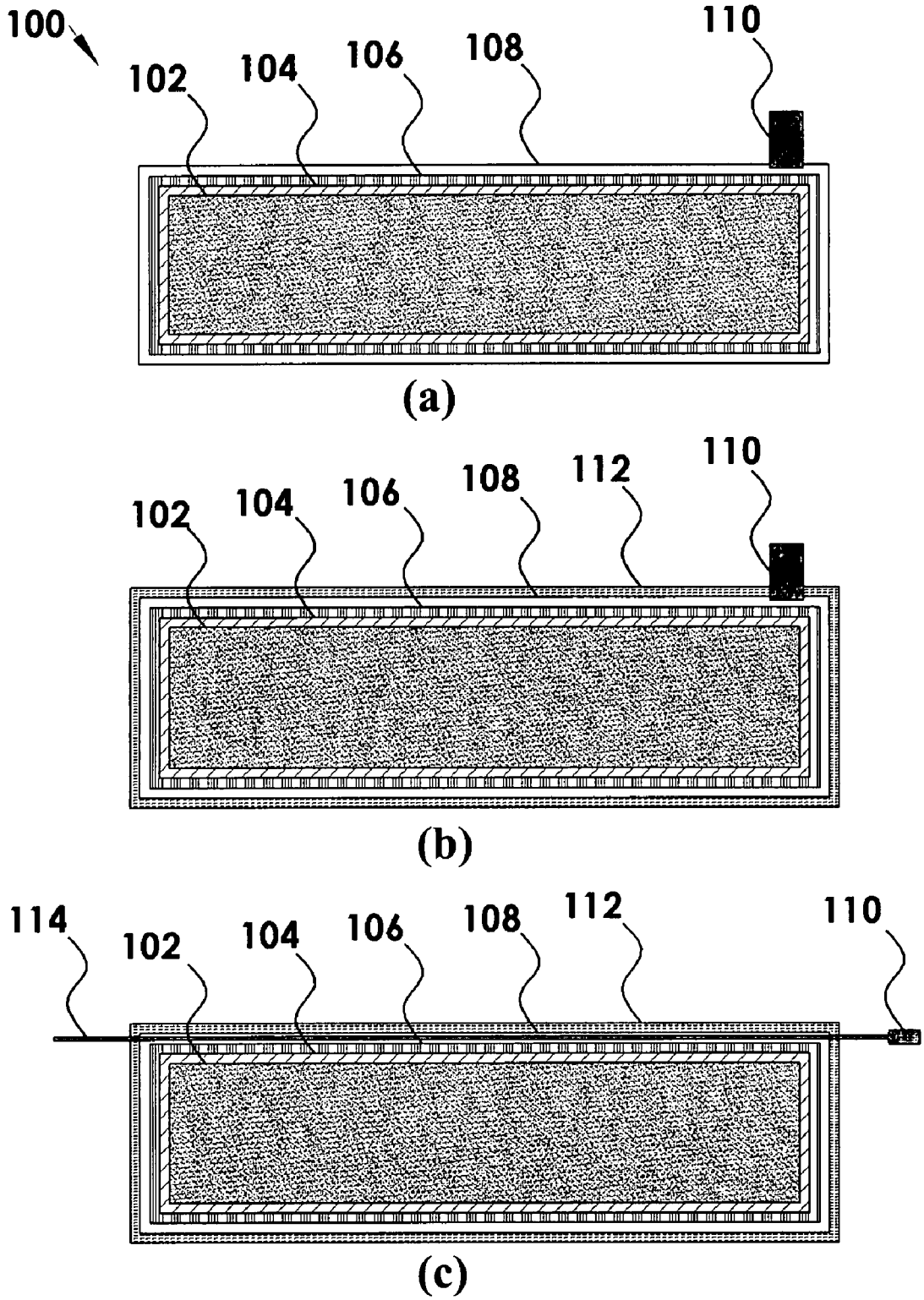
FIGS. 1*a*-1*c* show planar cross-section views of different embodiments of a flexible dilute explosive device according to the present invention.

The current invention is a flexible dilute explosive device that produces loading characteristics of lower peak pressure and longer duration than conventional explosives. FIGS. 1*a*-1*c* show planar cross-section views of different embodiments of the flexible dilute explosive device 100. Explosive material, such as pentaerythritol tetranitrate (PETN) or cyclotrimethylene trinitramine (RDX) and a non-reactive matrix material are combined to form a combination 102 that is placed in a first housing 104, where the non-reactive matrix material is a light-weight polymer bead such as pre-puffed polystyrene beads, expanded polypropylene (EPP), porous expanded polypropylene (P-EPP), or expanded polyethylene (EPE). These materials along with polystyrene have the advantage over other bead forms made from glass, ceramics, or metals of reducing the overall explosive density while not increasing the explosive sensitivity to be higher than conventional explosives. In this combination 102, there is an attraction between PETN and polystyrene beads that promotes the PETN to adhere to the surface of the polystyrene bead and thus, produces a thin coating of PETN around each pre-puffed bead. The first housing 104 may be a fabric bag or cotton bag. According to the current invention, the explosive material is a powder having gain sizes between 5 and 10 microns. The combination of the explosive material and select amounts of non-reactive matrix material can be placed in different first housings 104 having different volumes, which controls the device 100 explosive concentration level. The first housing 104 is then placed within an antistatic housing 106, such as a clear Velostat antistatic bag, which is sealed using an adhesive, such as tape, glue or the like, except for several small openings at one end (not shown) to allow air to be removed from the combination 102. The antistatic housing 106 is next placed within an vacuum housing 108, such as a vacuum bag. This vacuum housing 108 is then evacuated and sealed using a standard vacuum processing machine. A detonator 110 is then attached to the evacuated vacuum housing 108, as shown in FIG. 1*a*. In one aspect of the invention, hook and pile (not shown) are attached to the evacuated vacuum housing 108 for combining multiple evacuated housings.

Shown in FIG. 1*b* is an alternate embodiment of the current invention having an outer plastic coating 112 on the evacuated vacuum housing 108, where hook and pile material (not shown) may be attached to the plastic coating 112 for combining multiple evacuated housings 108 of flexible dilute explosive devices 100 easily in the field.

FIG. 1*c* shows the flexible dilute explosive device 100 having the plastic coating 112 of FIG. 1*b* with a detonation train. In this embodiment, the detonation train uses either a small amount of pure and dried explosive material (about 0.5 g per inch of bag length), such as pentaerythritol tetranitrate (PETN) or cyclotrimethylene trinitramine (RDX), or a detonator cord that has a linear density greater than 50 grains per foot that is placed along one edge (not shown) of the first housing 104. This element enhances the overall detonation transition probability between the detonation cord 114 and the device combination 102, where the detonator cord is attached to the evacuated vacuum housing 108 and positioned along the edge having the pure explosive material. Here the detonator cord 114 has a linear density greater than 50 grams per foot. A detonator 110 is then attached to the detonator cord 114. The detonator cord 114 can be Primacord (>50 gr./ft) or any detonator that has a detonation strength equal to or greater than a Cap 8 detonator. The detonator cord 114 also provides a means for connecting individual flexible dilute explosive devices 100 together and detonating them all at the same time with one detonator 110 placed on the end of the detonator core 114.

In another embodiment of the invention, the evacuated vacuum housing 108 may also be placed within another foil antistatic bag (not shown) to provide additional electrostatic protection. For this case, a small strip of antistatic plastic (not shown) is attached between the antistatic housing 106 inside the evacuated vacuum housing 108 and the foil antistatic bag (not shown) surrounding the evacuated vacuum housing 108. The leads (not shown) of the detonator cord 114 extend out through the outer foil antistatic bag. In situations that only require light duty handling, then no extra packaging system is required. Hook and pile (not shown) may be attached to the outer foil antistatic bag for combining multiple outer foil antistatic bags. Further, if the flexible dilute explosive device 100 will be used for situations that require severe handling conditions, then the additional protective layer prevents puncture of the vacuum bag. Here, the flexible dilute explosive device 100 is placed in an outer cotton or canvas bag, which is coated with a plastic coating 112 such as conventional Tool Dip, where hook and pile (not shown) may be attached to the plastic coating 112 for combining multiple plastic coatings 112.

The combination 102 can be transported in a separate antistatic housing 106 and then poured into any type of container prior to use in the field, where the container can have any shape or overall volume. Containers may consist of but are not limited to cardboard or plastics boxes and tubes, paper or plastic cups, plastic bottles, metal tubes, etc. The combination 102 is then compacted to obtain the desired explosive density.

Figure 2:
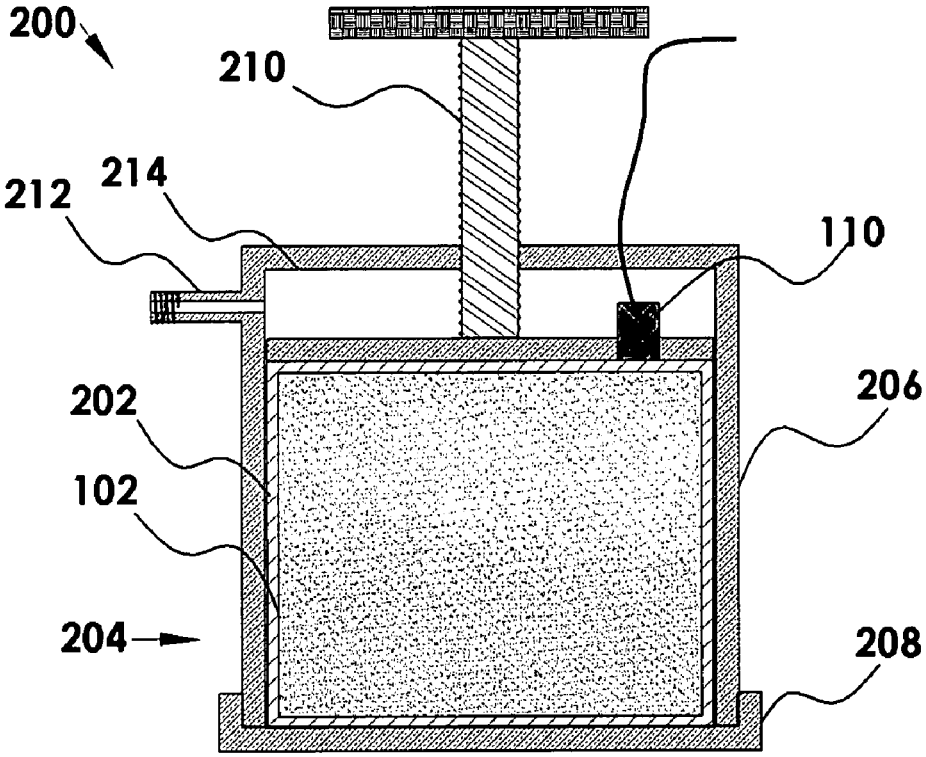
FIG. 2*a*-2*b* show planar cross-section views of a variable explosive concentration apparatus using a flexible dilute explosive device in an uncompressed state and a compressed state according to the present invention.
Figure 2:
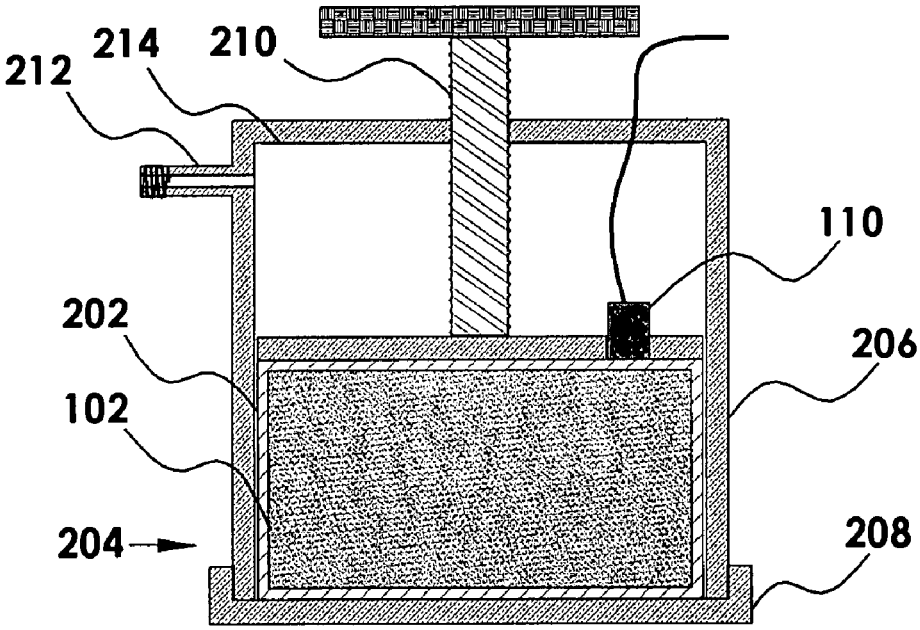

FIGS. 2*a* and 2*b* show planar cross-section views of a variable explosive concentration apparatus 200 using a flexible dilute explosive device 100 in an uncompressed state and a compressed state, respectively, according to the present invention. Shown in FIGS. 2*a* and 2*b* is a compression device 200 to tailor the explosive density, where the first housing 102 is a pliable antistatic bag 202, and where the antistatic housing 106 and evacuated housing 108 shown in FIGS. 1*a* and 1*b* are replaced by a variable-volume compression housing 204. The compression housing 204 enables selective compression of the combination 102 to a density between 0.10 and 0.50 grams per cubic centimeter. The apparatus that can be used to rapidly tailor the explosive density of the flexible dilute explosive device 100 in the field. Here, the combination 102 within the antistatic bag 202 is placed inside the antistatic housing 206. An antistatic end cap 208 is secured to the end with fast setting glue, for example. By turning the compression screw 210, the combination 102 volume can be adjusted to tailor the explosive density.

In an alternative embodiment of the invention, the compression housing 204 may have a compression valve 212 for providing pressurized gas or air to a compression chamber 214. When the compression chamber 214 is pressurized, the compression chamber 214 expands (see FIG. 2*b*) to compress the flexible dilute explosive device 100 and rapidly tailor the explosive density in the field, where a pressure gauge (not shown) may be provided on the antistatic housing 206.

Figure 3:
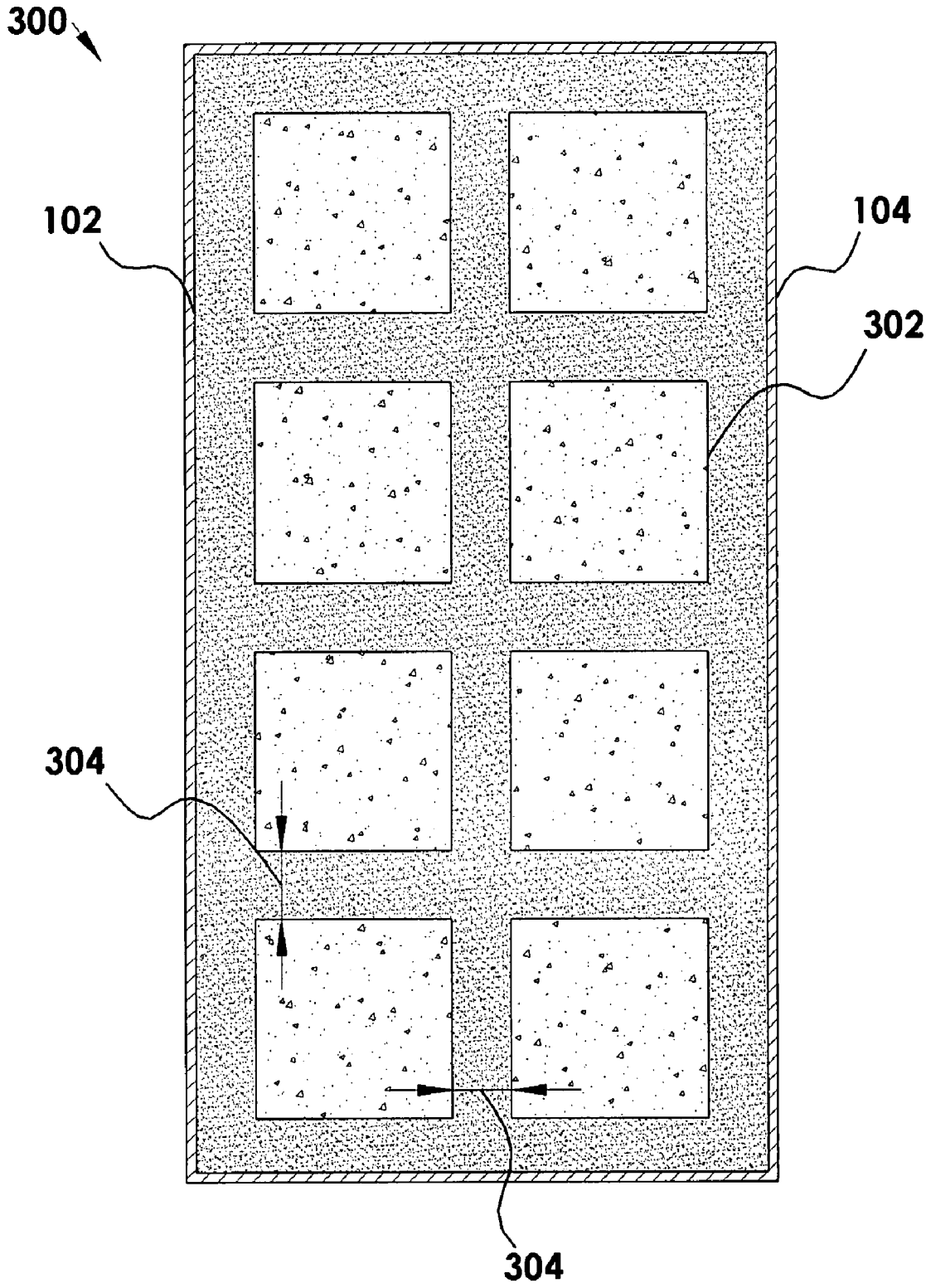
FIG. 3 shows a planar view of a flexible dilute explosive device with reduced overall volumetric explosive density according to the present invention.

For the embodiments described above, the overall system explosive density can be reduced below 6.25 lb/ft$^3$ (0.10 g/cm$^3$). FIG. 3 shows a reduced explosive density system 300 of the flexible dilute explosive device 100, where inert foam blocks 302 are added to the combination 102, where the combination 102 is shown only in a first housing 104 for illustrative purposes. By maintaining a clearance 304 of about 0.5 in. between each foam block, the combination 102 will completely detonate. With this embodiment the overall volumetric explosive density can be reduced to 2.5 lb/ft$^3$ (0.04 g/cm$^3$)

Figure 4:
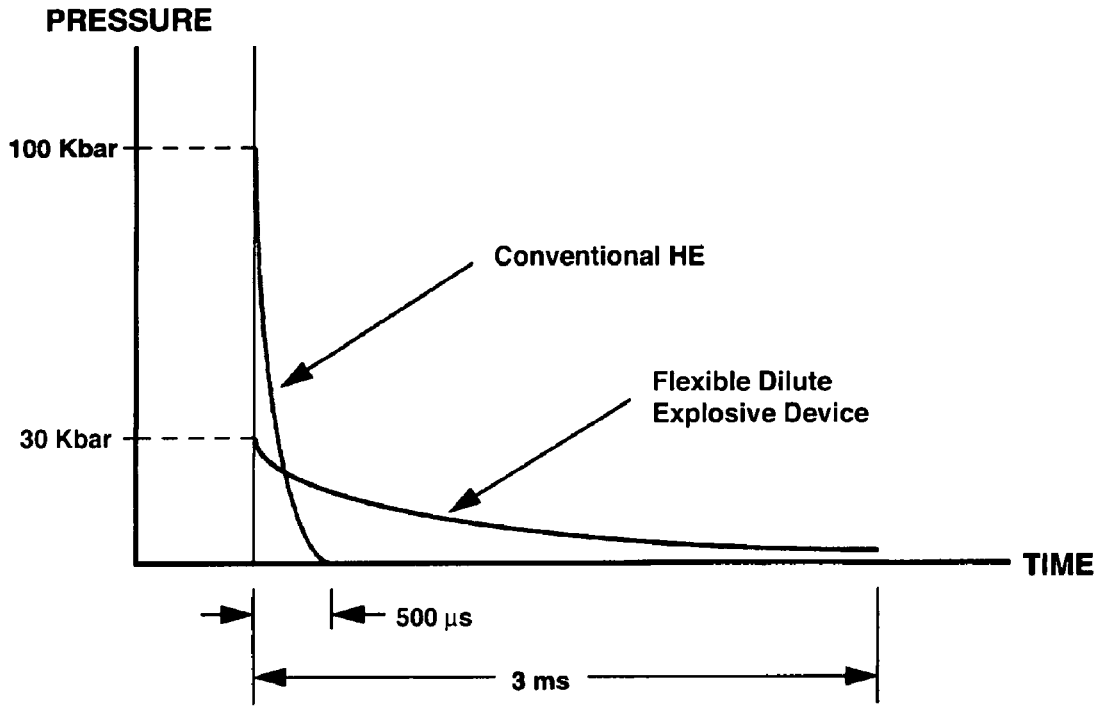
FIG. 4 shows a qualitative comparison of a conventional high-explosive pressure pulse with a pressure pulse from the flexible dilute explosive device according to the present invention.

Shown in FIG. 4. is a quantitative comparison of a pressure pulse from a high-explosive device and a pressure pulse provided by the flexible dilute explosive device 100 according to the current invention. In general, compared to conventional explosives, the flexible dilute explosive device produces lower pressures and longer durations.

Figure 5:
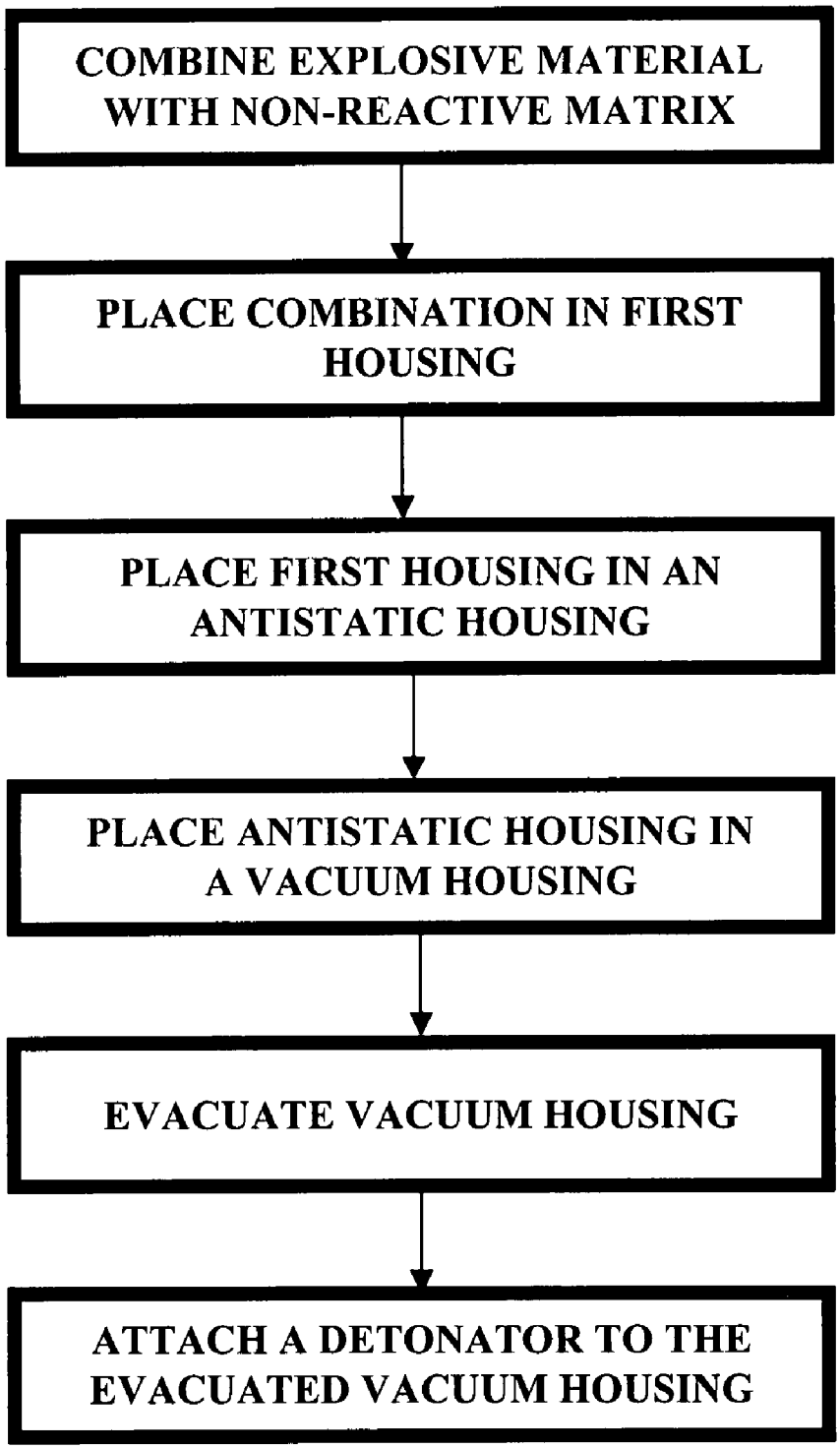
FIG. 5 shows a flow diagram of the steps for making the flexible dilute explosive device according to the present invention.

FIG. 5 shows the steps for a method of making the flexible dilute explosive device 100, according to one aspect of the invention. The combination 102 is prepared by mixing dry superfine explosive material, such as PETN, with the non-reactive matrix, such as pre-puffed polystyrene beads. The combination 102 is placed in a first housing 104, such as a cotton bag or a fabric bag having a volume to produce a desired explosive concentration. The first housing 104 is placed within an antistatic housing 106, such as a Velostat antistatic bag, and sealed except for several small openings at on end. The antistatic housing 106 is placed within a vacuum housing 108, such as a vacuum bag, which is then evacuated and sealed using a standard vacuum processing machine. A detonator 110, and an optional detonation train 114, such as Primacord, is attached to one edge of the evacuated vacuum housing 108. Additional foil antistatic bags or outer protective plastic coatings 112 may be added if required.

The explosive density is controlled by the ratio of explosive material to non-reactive matrix material, and the final volume of the combination. The weight ratio of PETN to pre-puffed polystyrene is nominally about eight. The flexible dilute explosive device 100 can be detonated with nominal combination 102 explosive densities greater than 6.25 lb/ft$^2$ (0.10 g/cm$^3$). The flexible dilute explosive device 100 is Cap 8 sensitive, and thus, can be detonated with all detonators that are equal to or greater than a standard Cap 8 detonator. The flexible dilute explosive device 100 can be fabricated with combination explosive densities up to 31.25 lb/ft$^3$ (0.50 g/cm$^3$) to provide a range of attenuated explosive loading conditions.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For example the different arrangements enable the flexible dilute explosive device 100 to be applied to any contoured shape in the field. The flexible dilute explosive device 100 total density is typically between 5 to 10% greater than its explosive density. By using different packaging, the flexible dilute explosive device 100 can be made to have a fixed explosive density or a field tailored explosive density. The flexible dilute explosive device 100 can be reliably detonated at lower explosive densities. The flexible dilute explosive device 100 presents a number of advantages including a flexible packaging system, reduced fabrication time and costs, lower overall weight, lower explosive density detonation ability, and field tailorable explosive density.

All such variations are considered to be within the scope and spirit of the present invention as defined by the following claims and their legal equivalents.

What is claimed is:

1. A flexible dilute explosive device, comprising:

a. a first housing;

b. an antistatic housing enclosing said first housing;

c. an evacuated housing enclosing said antistatic housing;

d. a combination of an explosive material and a non-reactive matrix material, wherein said combination is encased in said first housing; and e. a detonator attached to said evacuated housing.

2. The device as set forth in claim 1, wherein said explosive material is a powder having grain sizes between 5 and 10 microns.

3. The device as set forth in claim 2, wherein said explosive material is selected from a group consisting of pentaerythritol tetranitrate (PETN), and cyclotrimethylene trinitramine (RDX).

4. The device as set forth in claim 1, wherein said non-reactive matrix material is a light-weight polymer bead selected from a group consisting of pre-puffed polystyrene beads, expanded polypropylene (EPP), porous expanded polypropylene (P-EPP), and expanded polyethylene (EPE).

5. The device as set forth in claim 1, wherein said combination has a weight ratio of said explosive material to said non-reactive matrix material of about eight.

6. The device as set forth in claim 1, wherein said antistatic housing is sealed and has a plurality of openings at an end of said antistatic housing.

7. The device as set forth in claim 1, wherein said evacuated housing is an evacuated bag.

8. The device as set forth in claim 1, wherein said first housing is a fabric bag.

9. The device as set forth in claim 1, wherein said first housing is a cotton bag.

10. The device as set forth in claim 1, wherein said detonator has a detonation strength equal to or greater than a Cap 8 detonator.

11. The device as set forth in claim 1, wherein said combination has a mixture density between 0.10 and 0.50 grams per cubic centimeter.

12. The device as set forth in claim 1, wherein said detonator is a detonation train comprising:

a. said explosive material positioned along an edge of said first housing, wherein said explosive material has a linear density of about 0.5 grams per inch of length of said first housing; and b. a detonator cord attached to said evacuated housing and positioned along said edge, wherein said detonator cord has a linear density greater than 50 grains per foot.

13. The device as set forth in claim 1, further comprises an outer plastic coating on said evacuated housing.

14. The device as set forth in claim 13, wherein hook and pile are attached to said plastic coating for combining multiple said evacuated housings.

15. The device as set forth in claim 1, wherein said first housing is an antistatic bag, and wherein said antistatic housing and said evacuated housing are replaced by a compression housing having a variable-volume, whereby said compression housing enables selective compression of said combination to a density between 0.10 and 0.50 grams per cubic centimeter.

16. The device as set forth in claim 1, wherein hook and pile are attached to said evacuated housing for combining multiple said evacuated housings.

17. The device as set forth in claim 1, wherein said non-reactive matrix further comprises non-reactive matrix blocks having at least 0.5 inch spacing there between.

18. The device as set forth in claim 17, wherein said combination has an explosive density as low as 0.04 grams per cubic centimeter.

19. A method of fabricating a flexible dilute explosive device, comprising the steps of:

a. combining an explosive material with a non-reactive matrix;
b. placing said combination in a first housing;
c. placing said first housing in an antistatic housing;
d. placing said antistatic housing in a vacuum housing;
e. evacuating said vacuum housing; and
f. attaching a detonator to said evacuated vacuum housing.

* * * * *